US007329082B2

(12) United States Patent
Warren

(10) Patent No.: US 7,329,082 B2
(45) Date of Patent: Feb. 12, 2008

(54) ELECTRICALLY ACTUATED ATTACHMENT SYSTEM FOR TRACTOR FRONT END LOADERS

(75) Inventor: Alan T. Warren, Hermitage, PA (US)

(73) Assignee: Ultra-Tach, LLC, Sharpsville, PA (US)

( * ) Notice: Subject to any disclaimer, the term of this patent is extended or adjusted under 35 U.S.C. 154(b) by 136 days.

(21) Appl. No.: 11/231,187

(22) Filed: Sep. 20, 2005

(65) Prior Publication Data

US 2006/0210384 A1 Sep. 21, 2006

Related U.S. Application Data

(60) Provisional application No. 60/611,862, filed on Sep. 21, 2004.

(51) Int. Cl.
*E02F 3/00* (2006.01)

(52) U.S. Cl. ..... 414/723; 37/468; 403/322.1

(58) Field of Classification Search ..... 414/723; 37/468; 403/321, 322.1, 322.3, 322.4, 324, 403/325

See application file for complete search history.

(56) References Cited

U.S. PATENT DOCUMENTS

| | | | | |
|---|---|---|---|---|
| 3,269,570 | A | 8/1966 | Wallberg | |
| 3,672,521 | A | 6/1972 | Bauer et al. | |
| 3,732,996 | A | 5/1973 | Bauer | |
| 3,984,016 | A | 10/1976 | Kuhn | |
| 5,098,252 | A | 3/1992 | Sheesley et al. | |
| 5,107,610 | A | 4/1992 | Fusco | |
| 5,562,397 | A | 10/1996 | Albright | |
| 5,651,653 | A * | 7/1997 | Bablo | 414/24.5 |
| 5,769,596 | A | 6/1998 | Burton | |
| 5,974,706 | A | 11/1999 | Kaczmarski et al. | |
| 5,983,535 | A | 11/1999 | Kaczmarski et al. | |
| 6,000,154 | A | 12/1999 | Berard et al. | |
| 6,030,169 | A | 2/2000 | Rossow et al. | |
| 6,163,989 | A | 12/2000 | Kaczmarski et al. | |
| 6,390,765 | B1 * | 5/2002 | Dick | 414/723 |
| 6,431,049 | B1 * | 8/2002 | Berg et al. | 91/420 |
| 6,499,934 | B1 | 12/2002 | Kaczmarski et al. | |
| 6,539,650 | B2 | 4/2003 | Kaczmarski et al. | |
| 6,698,114 | B2 | 3/2004 | Bares et al. | |
| 6,773,223 | B2 | 8/2004 | Harris et al. | |
| 6,860,707 | B2 | 3/2005 | Roan et al. | |
| 6,902,016 | B2 | 6/2005 | Bares et al. | |
| 6,907,941 | B1 * | 6/2005 | Hoffart | 172/272 |
| 6,923,285 | B1 | 8/2005 | Rossow et al. | |
| 2002/0064446 | A1 * | 5/2002 | Dvorak et al. | 414/723 |

* cited by examiner

*Primary Examiner*—Donald Underwood
(74) *Attorney, Agent, or Firm*—Alan G Towner, Esq; Pietragallo Bosick & Gordon, LLP

(57) ABSTRACT

Electrically actuated quick attach systems for tractor front end loaders are disclosed. An electric actuator with extendable rods is connected to rotatable handles mounted on attachment mounting plates. Extension of the electric actuator rods rotates the handles and causes attachment locking pins to extend into locking positions. Retraction of the electric actuator rods rotates the handles in opposite directions and causes the locking pins to retract into unlocked positions. The electrically actuated quick attach systems may be used with compact utility tractors as well as other types of tractors.

25 Claims, 16 Drawing Sheets

ELECTRICALLY ACTUATED ATTACHMENT SYSTEM FOR TRACTOR FRONT END LOADERS

CROSS-REFERENCE TO RELATED APPLICATION

This application claims the benefit of U.S. Provisional Patent Application Ser. No. 60/611,862 filed Sep. 21, 2004, which is incorporated herein by reference.

FIELD OF THE INVENTION

The present invention relates to tractor front end loaders, and more particularly relates to electrically actuated systems for locking and unlocking attachments to compact utility tractors and other types of tractors.

BACKGROUND INFORMATION

Tractors are often equipped with front end loaders which may be used with various attachments such as buckets, forks, bale spears and the like. For example, compact utility tractor front end loaders typically have lifting capacities of 800-5,000 pounds and are mounted on tractors which typically range in horsepower from 18-45. Larger tractors having horsepowers of up to 150 or more and greater lifting capacities may also utilize front end loaders and attachments. Such tractors with front end loaders are used in commercial, agricultural, landscaping, residential and other applications.

Conventional quick attach systems for tractors such as compact utility tractors allow operators of the tractors to quickly change the attachments on the front end loader by manually moving levers which lock and unlock the attachment to the quick attach system by means of retractable locking pins. The mounting envelope or size of such systems is an industry standard which is common among compact utility tractor front end loaders. This standard is the SAE Surface Vehicle Standard J2513.

SUMMARY OF THE INVENTION

The present invention provides an electrically powered actuator for tractor quick attach systems. By activating the electric actuator, the operator has the ability to lock and unlock an attachment to the tractor quick attach system from the tractor operator's position. Tractor front end loader attachments may be quickly and conveniently changed with the present electric actuator in comparison with conventional systems which require manual movement of levers by the operator.

An aspect of the present invention is to provide an attachment system for mounting attachments to a tractor. The attachment system comprises handles pivotally mounted on tractor attachment mounting plates. Each handle includes a connection to an attachment locking pin and another connection to an actuator end clevis. An electric actuator is connected to the end clevises. In one embodiment, the electric actuator extends the end clevises linearly away from each other to rotate the handles and locking pins to downward locked positions. Retraction of the end clevises toward the actuator rotates the handles and retracts the locking pins to their unlocked positions.

Another aspect of the present invention is to provide a handle for a tractor attachment mounting system. The handle comprises a first region structured and arranged for pivotal mounting of the handle on a tractor attachment mounting plate, a second region structured and arranged for connecting an attachment locking pin to the handle, and a third region structured and arranged for connecting an electric actuator end clevis to the handle.

These and other aspects of the present invention will be more apparent from the following description.

DETAILED DESCRIPTION

Figure 1:
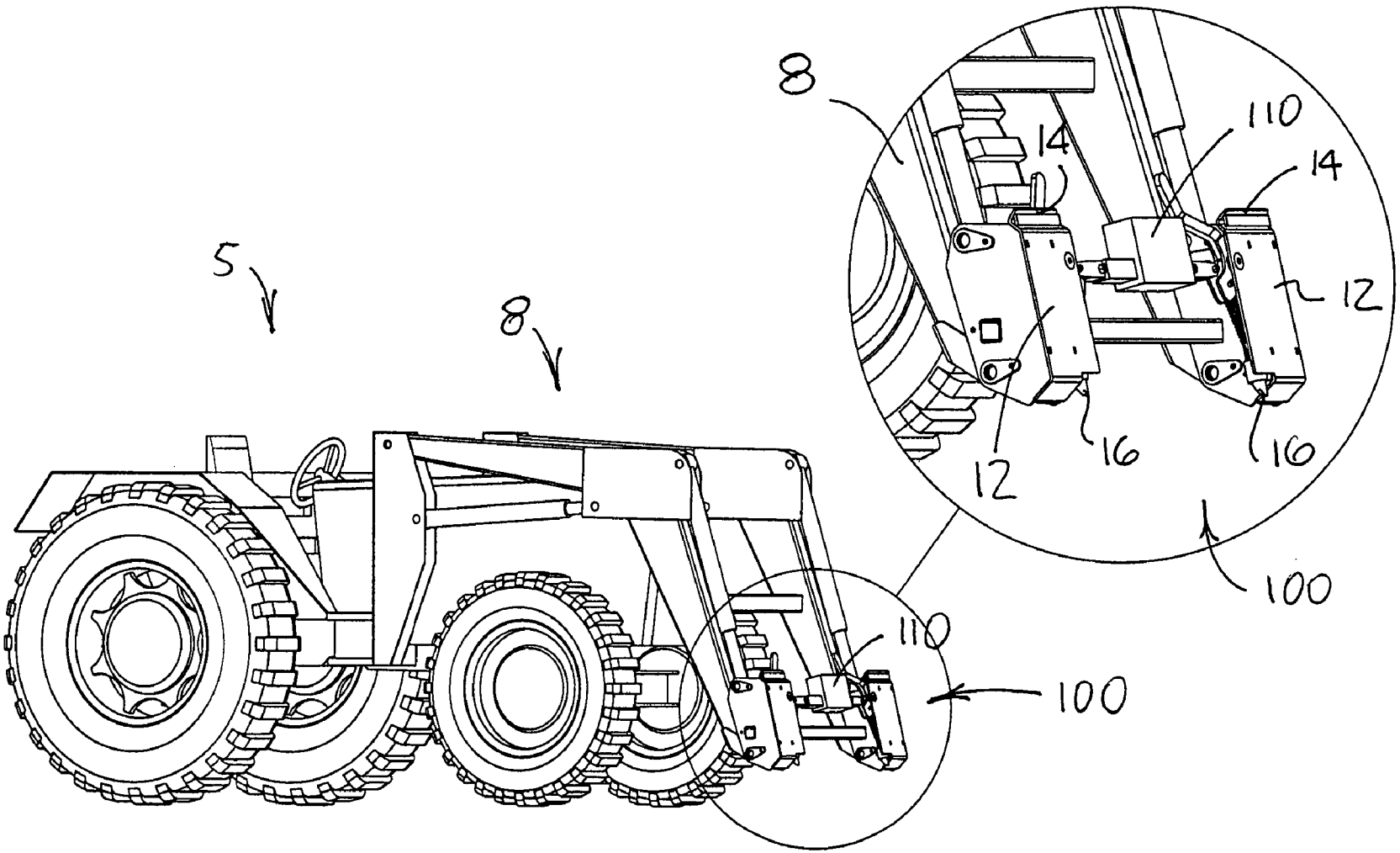
FIG. 1 is an isometric view of a compact utility tractor front end loader including an electrically actuated quick attach system in accordance with an embodiment of the present invention.

FIG. 1 illustrates a compact utility tractor 5 including a front end loader 8 which may be equipped with an electrically actuated attachment system 100 in accordance with an embodiment of the present invention. As shown most clearly in the enlarged section of FIG. 1, the electrically actuated attachment system 100 includes an electric actuator 110 mounted on a quick attach mechanism including mounting plates 12, upper support members 14 and extendable locking pins 16. The quick attach system is configured for attachment to conventional compact utility tractor attachments such as buckets, forks, bale spears and the like. Although attachment systems for compact utility tractors are primarily described herein, it is understood that the present electrically actuated attachment system may be used with other types of tractors as well.

Figure 2:
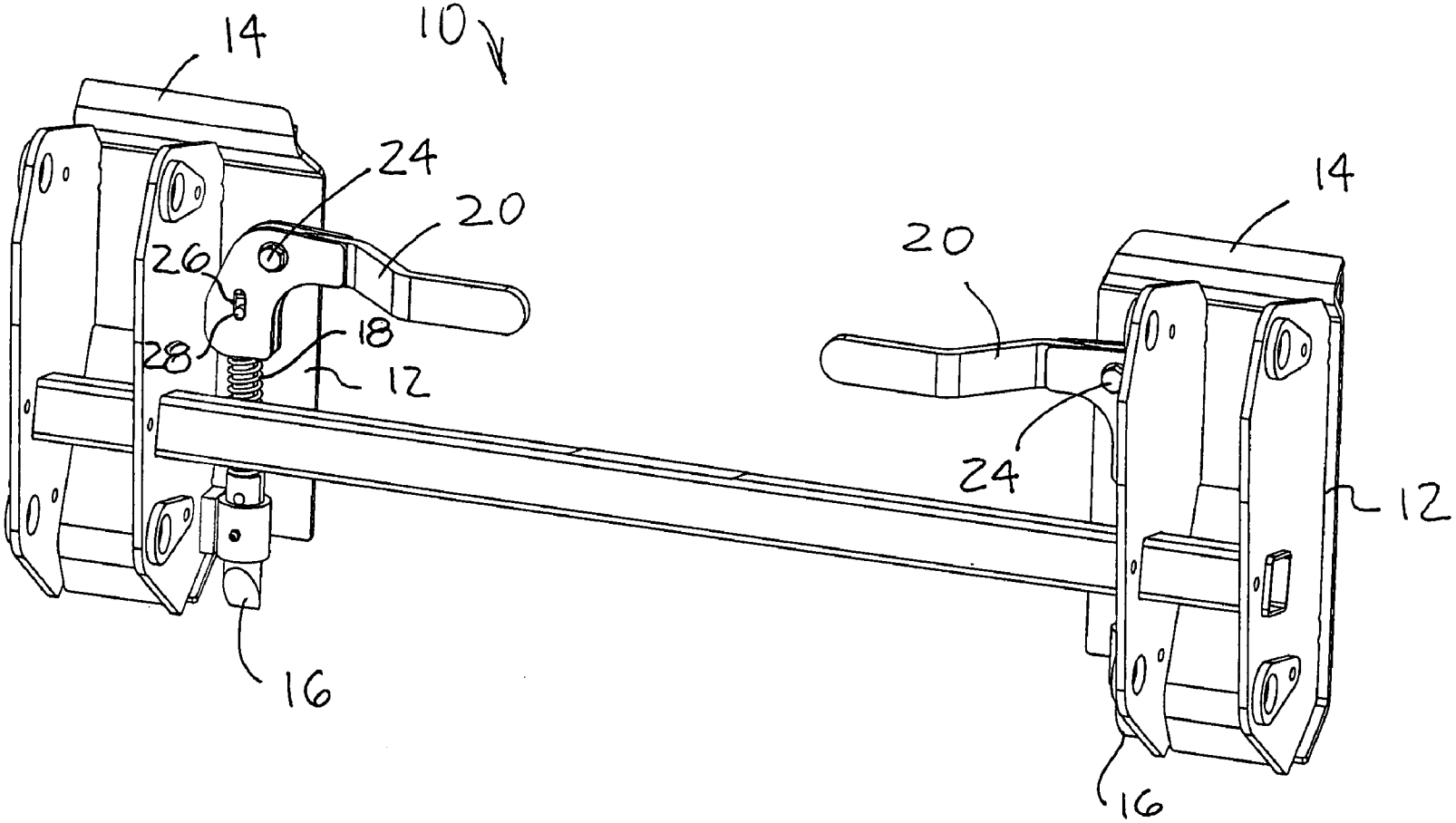
FIG. 2 is an isometric view of a conventional manually operated quick attach system.

FIG. 2 illustrates a conventional manual quick attach system 10 including standard mounting plates 12, upper support members 14, extendable locking pins 16 and locking pin springs 18. Manually operated handles 20 are pivotally mounted on the mounting plate 12 by bolts 24. Each handle 20 also includes a slot 26 in which a locking pin connector 28 is retained. The locking pin connector 28 is connected to the extendable locking pin 16 by means of a pivotable linkage. In the position shown in FIG. 2, the handles 20 are in downward positions, and the locking pins 16 are extended to their downward locking positions. Manual movement of the handles 20 upward from their positions shown in FIG. 2 causes rotation of the handles 20 around the bolts 24 and retraction of the locking pins 16 upward to their unlocked positions.

FIGS. 3-6 and 9 illustrate an electrically actuated attachment system 100 in accordance with an embodiment of the present invention. The system includes an electric actuator 110 controlled by a switch 111 which may be mounted at any suitable location on the compact utility tractor. The electric actuator 110 includes a stationary rod at one end and an extendable rod 112 at the other end which may be extended away from and retracted toward the electric actuator 110. Although a single extendable rod 112 is shown in this embodiment, the electric actuator 110 may alternatively include two rods extendable in opposite directions from the actuator. The rods of the electric actuator 110 include end clevises 114 which are connected by bolts 134 to handles 120 which include hand grip levers. As more fully described below, when the switch 111 is activated, the electric actuator 110 extends, which moves the handles 120 downward to engage the locking pins 16 into the attachment. Depressing the switch 111 reverses the direction of movement of the electric actuator 110 and cause the handles 120 to rotate upward and the locking pins 16 to disengage. Any suitable electric actuator 110 may be adapted for use in accordance with the present invention, for example, an electric actuator with an internal clutch sold by Linak U.S. Inc. under the designation LA36.

Each handle 120 includes a handle mounting hole 122 (most clearly shown in FIGS. 8 and 9) through which a handle mounting bolt 124 extends in order to pivotally connect the handle 120 to the mounting plate 12. The handle 120 also includes a slot 126 which retains a locking pin connector 128 that is connected by a pivotable linkage surrounded by the spring 18 to the extendable locking pin 16. The handle 120 further includes an extended actuator mounting tab 130 for connection to the end clevis 114 of the electric actuator 110. The actuator mounting tab 130 has an actuator mounting hole 132 extending therethrough (most clearly shown in FIGS. 8 and 9).

Figure 3:
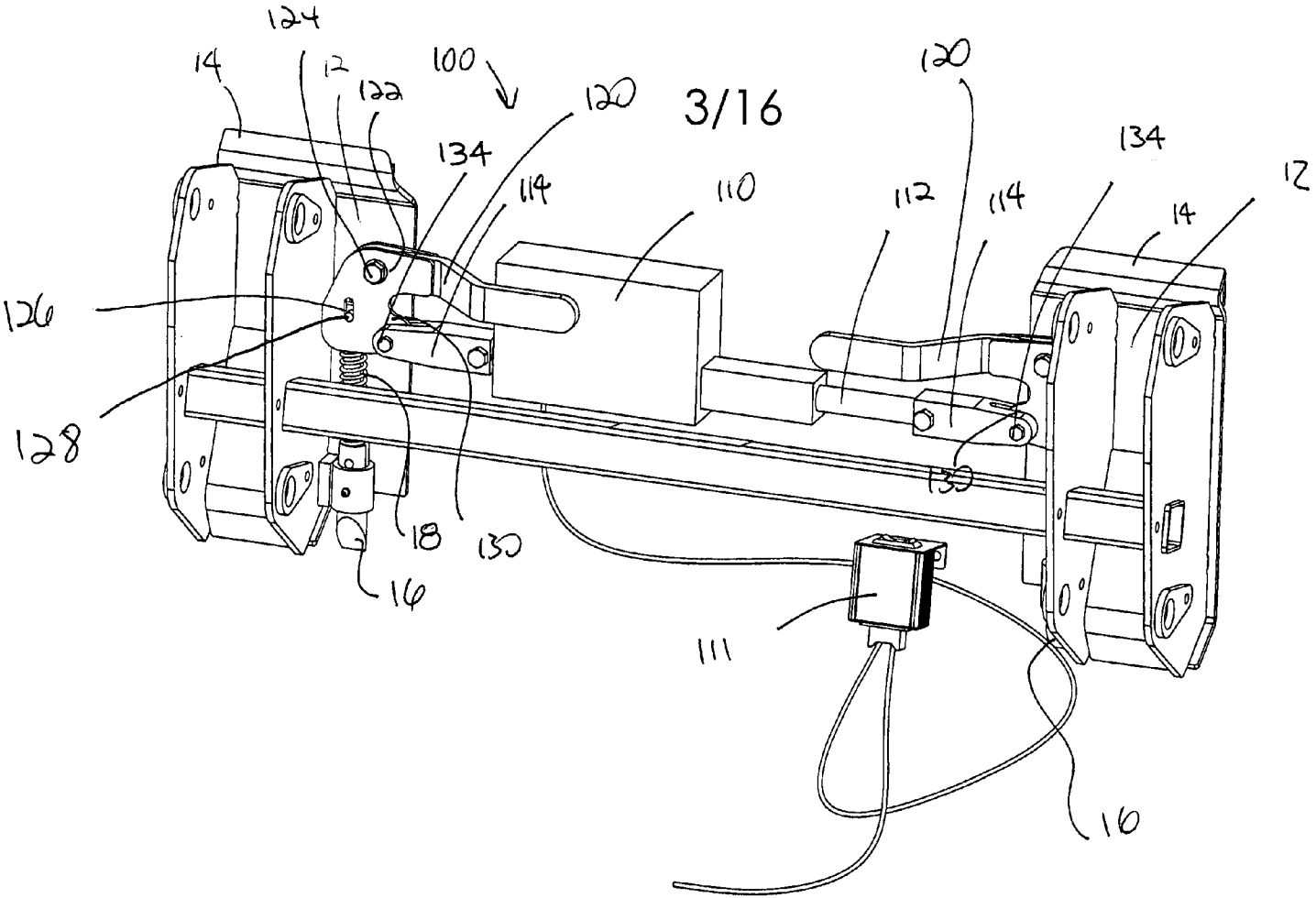
FIG. 3 is an isometric view of an electrically actuated quick attach system of the present invention as shown in FIG. 1.
Figure 4:
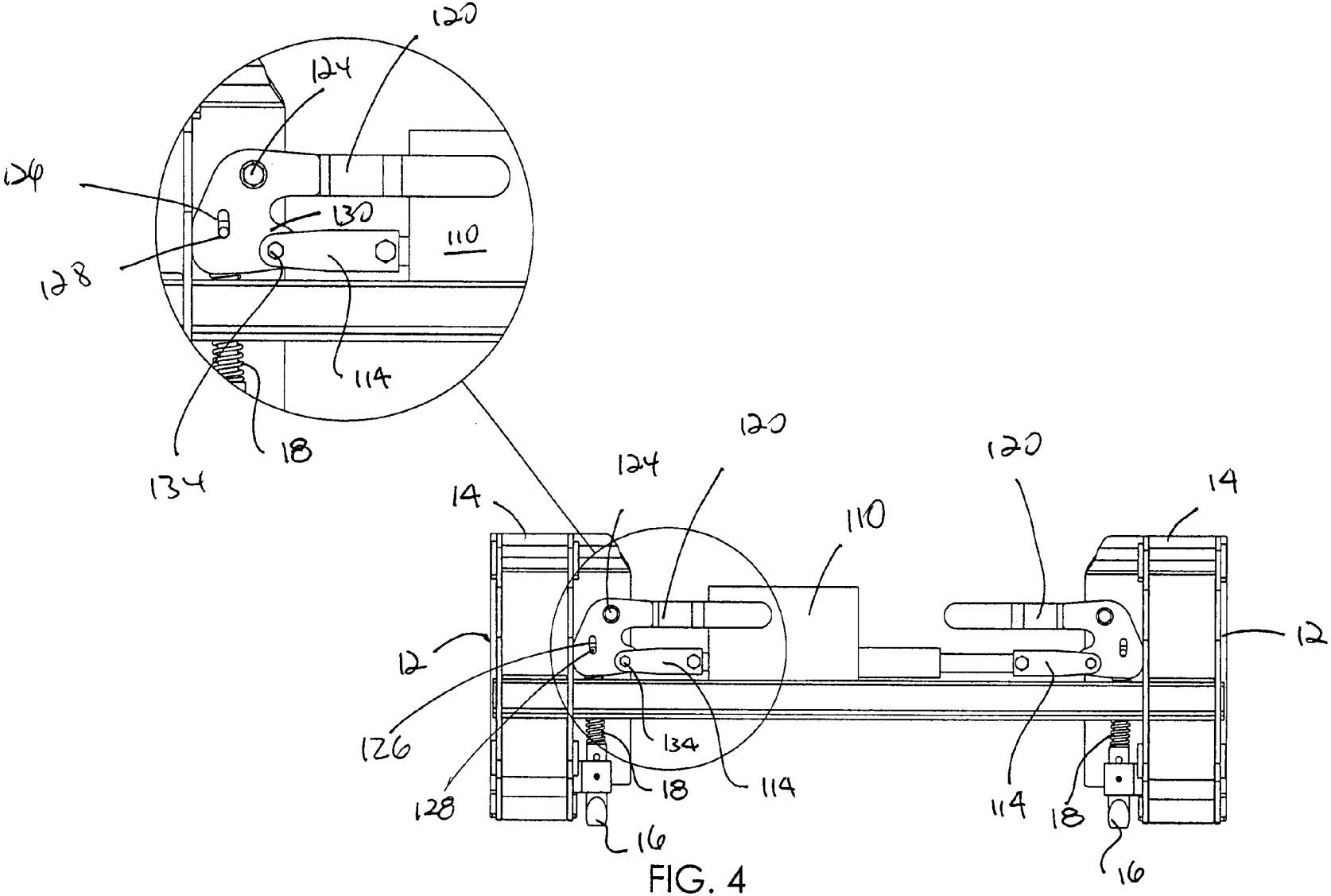
FIG. 4 is an elevational view of an electrically actuated quick attach system as shown in FIGS. 1 and 3, with the handles and locking pins in engaged positions.

In FIGS. 3 and 4, the end clevises 114 of the electric actuator 110 are extended, and the handles 120 are in their downward positions with their hand grip levers extending substantially horizontally. In this position, the locking pins 16 are also extended to their downward locking positions. A portion of each handle 120 contacts a sidewall of the mounting plate 12 to stop rotation of the handle 120 in this position.

Figure 5:
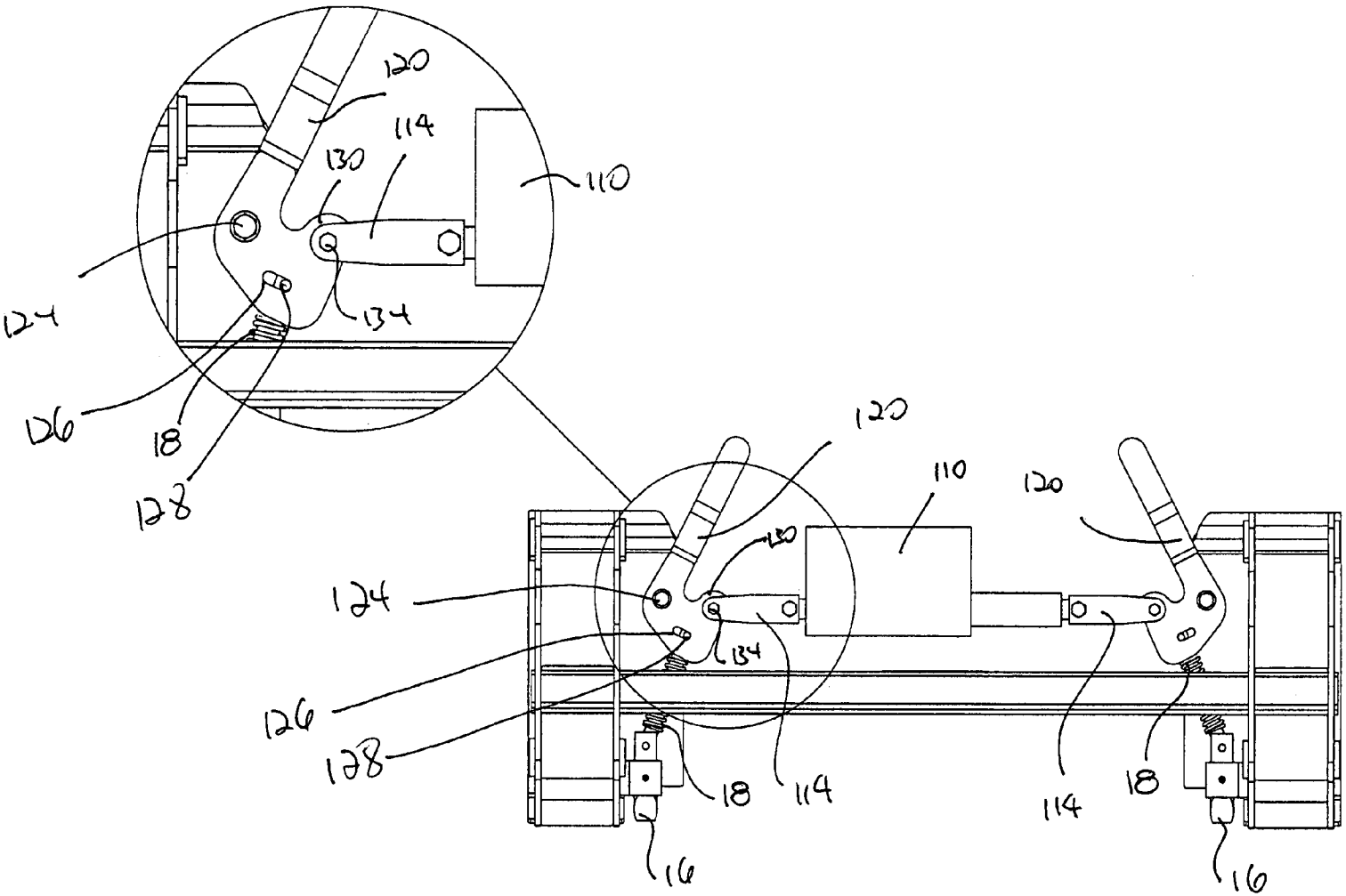
FIG. 5 is an elevational view of an electrically actuated quick attach system as shown in FIGS. 1, 3 and 4, with the handles and locking pins in disengaged positions.

In FIG. 5, the end clevises 114 of the electric actuator 110 are retracted to rotate the handles 120 around their handle mounting bolts 124 to their upward positions with their hand grip levers extending upward. In this position, the slots 126 and their respective locking pin connectors 128 have been rotated to thereby retract the locking pins 16 to their upward unlocked positions. In this position, the electric actuator 110 may be in its fully retracted, end of stroke position.

Figure 6:
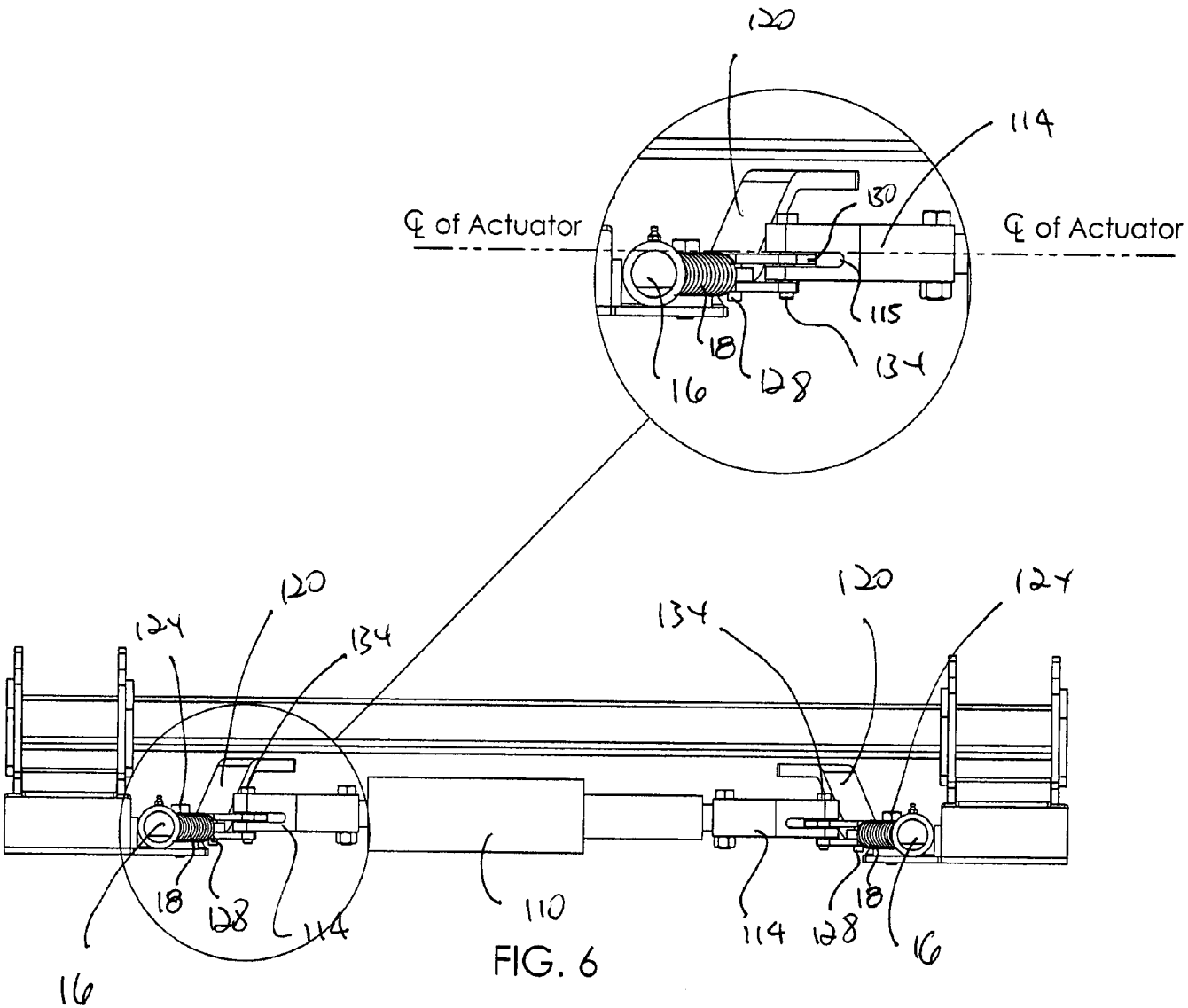
FIG. 6 is a bottom view of the electrically actuated quick attach system of FIG. 5.
Figure 9:
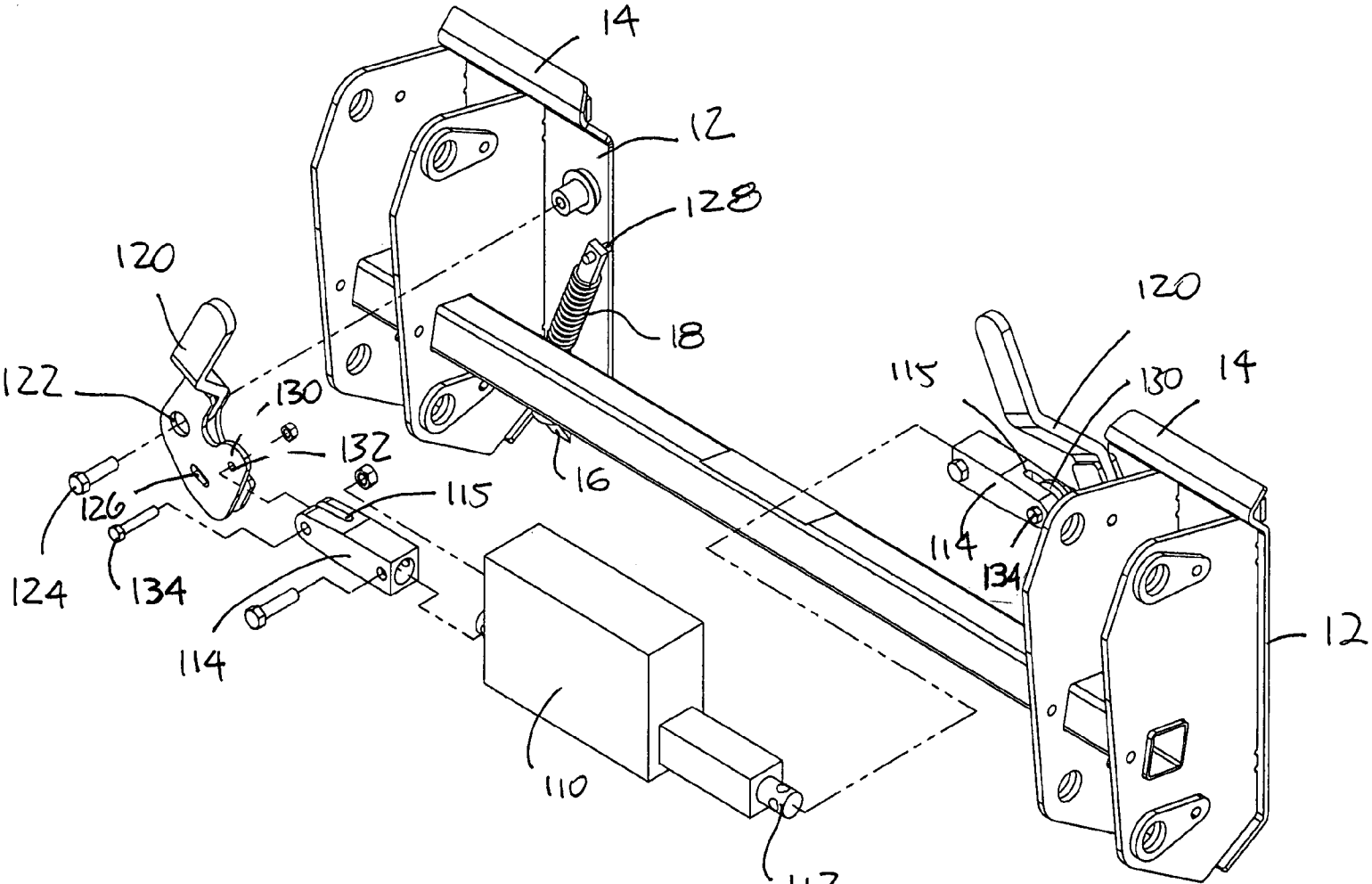
FIG. 9 is an exploded isometric view of the electrically actuated quick attach system shown in FIGS. 5 and 6.

FIG. 6 is a bottom view and FIG. 9 is an exploded isometric view illustrating details of the arrangement of the end clevises 114 of the electric actuator 110 in relation to the handles 120. Each end clevis 114 has a slot 115 which is aligned close to the center line of the electric actuator 110. The extended actuator mounting tab 130 of each handle 120 extends into the slot 115 of the actuator end clevis 114, and the bolt 134 connects these components together. This arrangement, with the centerline of the electric actuator 110 closely aligned with the clevis slot 115 and the actuator mounting tab 130 of the handle 120, provides improved operation and reliability for the electric actuator 110 by reducing or eliminating side deflection or cantilever type loading conditions.

The embodiment shown in FIGS. 3-6 and 9 has the end clevises 114 of the electric actuator 110 arranged such that they straddle the actuator mounting tab 130 handle 120 and place the centerline of load as close as possible to the centerline of the electric actuator 110. When the electric actuator 110 is operated in this configuration, side deflection is within recommended specifications and the operational life of the actuator is maximized.

Figure 7:
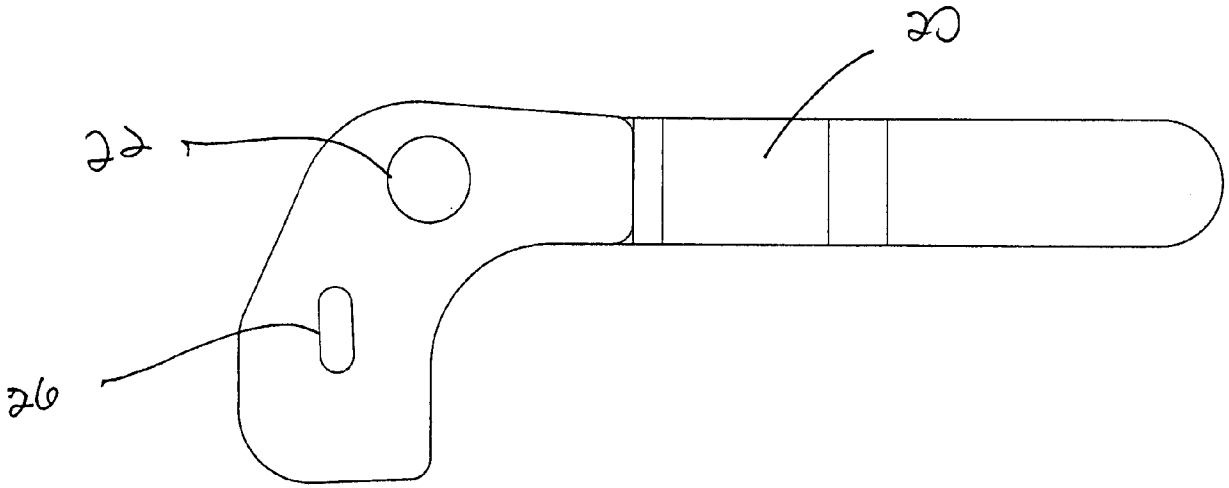
FIG. 7 is a front view of a manually operated quick attach handle.
Figure 8:
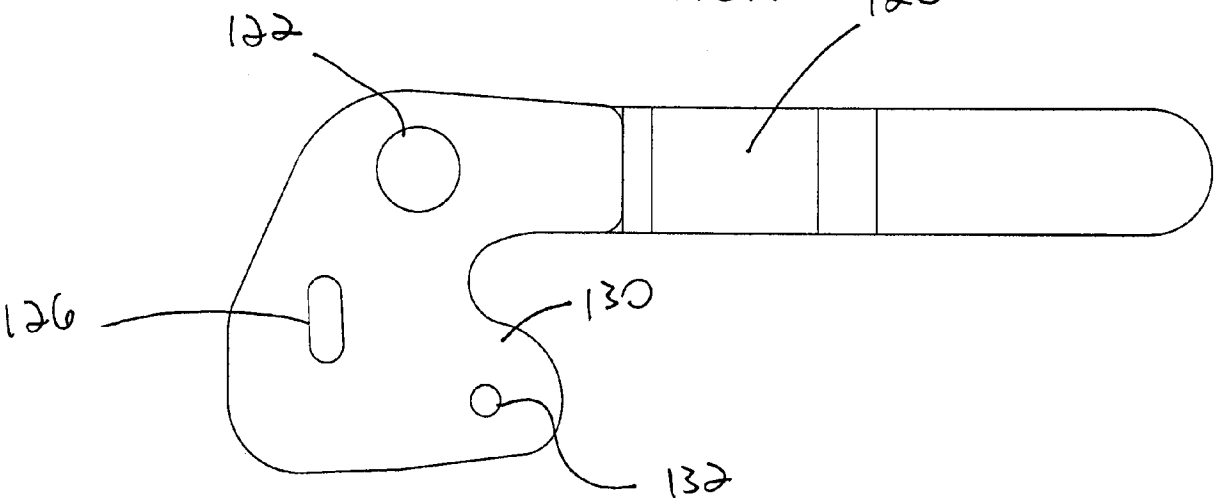
FIG. 8 is a front view of an electrically actuated quick attach handle including an extended portion having a hole for connection to an electric actuator clevis in accordance with an embodiment of the present invention.

FIGS. 7 and 8 illustrate a manual quick attach handle 20 and an electrically actuated handle 120 in accordance with an embodiment of the present invention, respectively. As shown in FIG. 7, the manual handle 20 includes a mounting hole 22 for pivotable attachment of the handle 20 to the quick attach mounting plates 12. The manual handle 20 also includes a slot 26 for the locking pin connector 28 of the extendable locking pin 16. As shown in FIG. 8, the handle 120 in accordance with an embodiment of the present invention includes a similar handle mounting hole 122 and a similar slot 126. However, the handle 120 further includes the extended actuator mounting tab 130 and actuator mounting hole 132 extending therethrough for connection to the electric actuator 110, as described above. The handle mounting hole 122, locking pin linkage slot 126 and actuator mounting hole 132 are arranged at different positions or regions in the plane of the handle 120.

Figure 10:
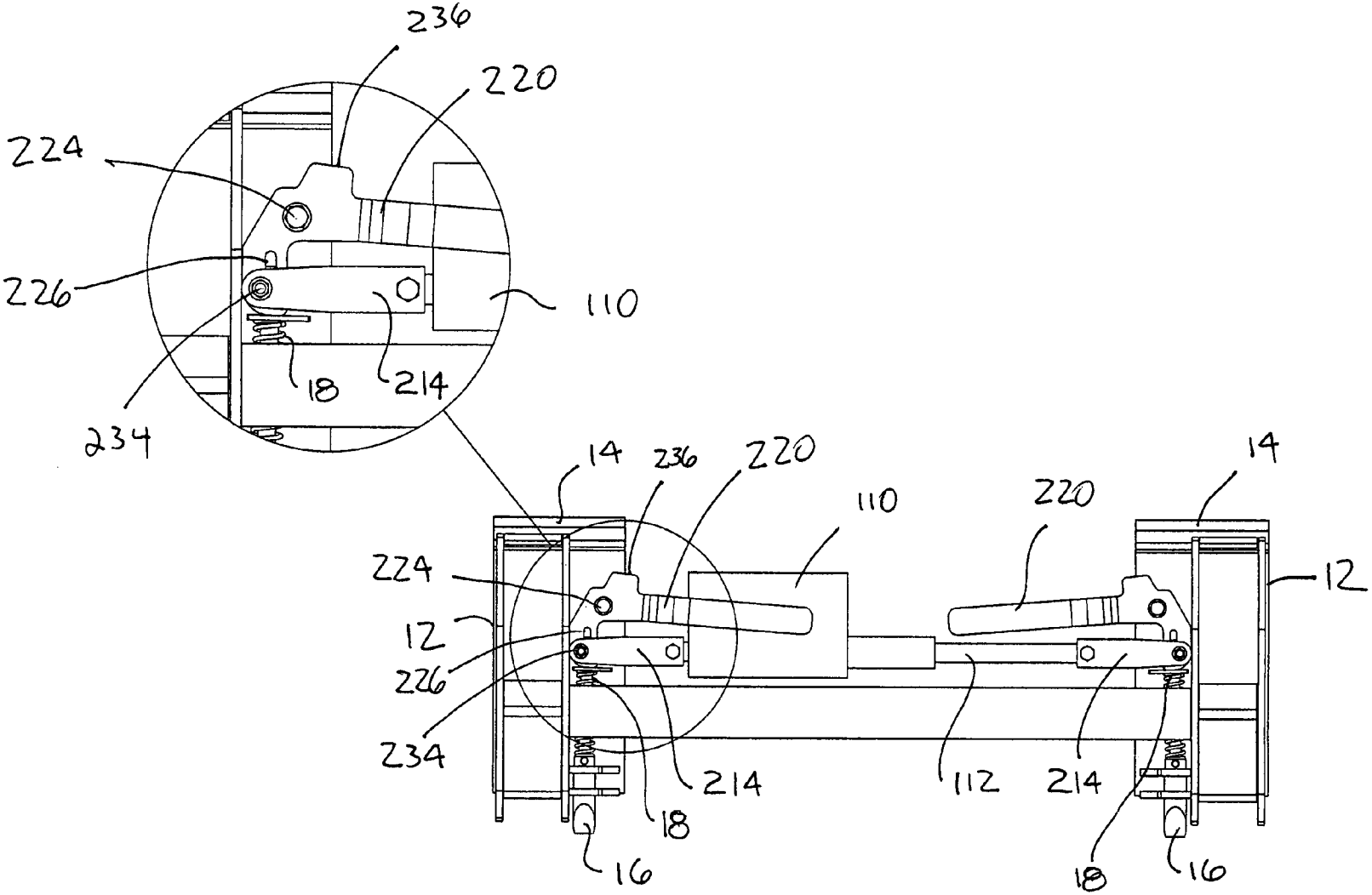
FIG. 10 is an elevational view of an electrically actuated quick attach system in accordance with another embodiment of the present invention, with the handles and locking pins in engaged positions.
Figure 11:
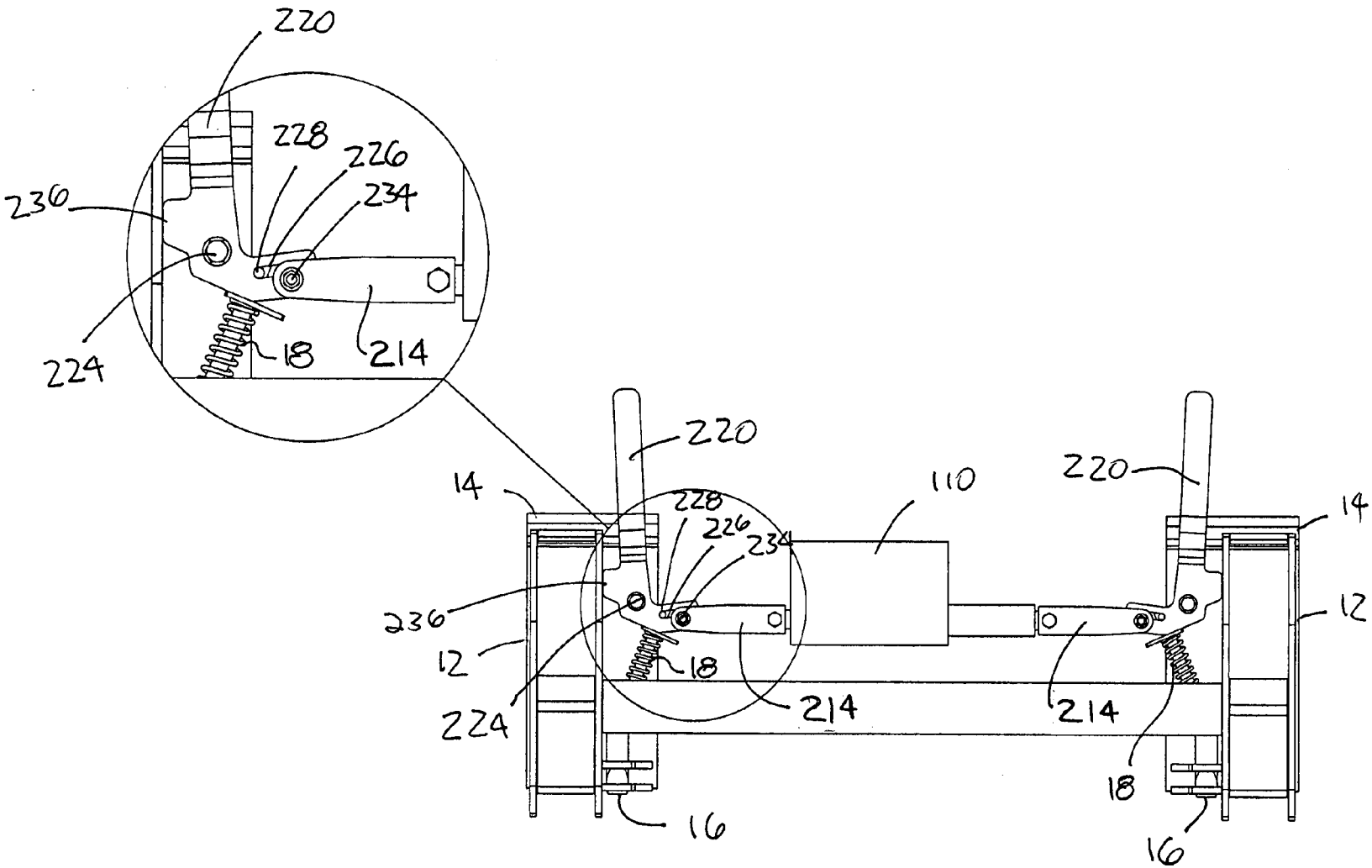
FIG. 11 is an elevational view of the electrically actuated quick attach system shown in FIG. 10, with the handles and locking pins in disengaged positions.
Figure 12:
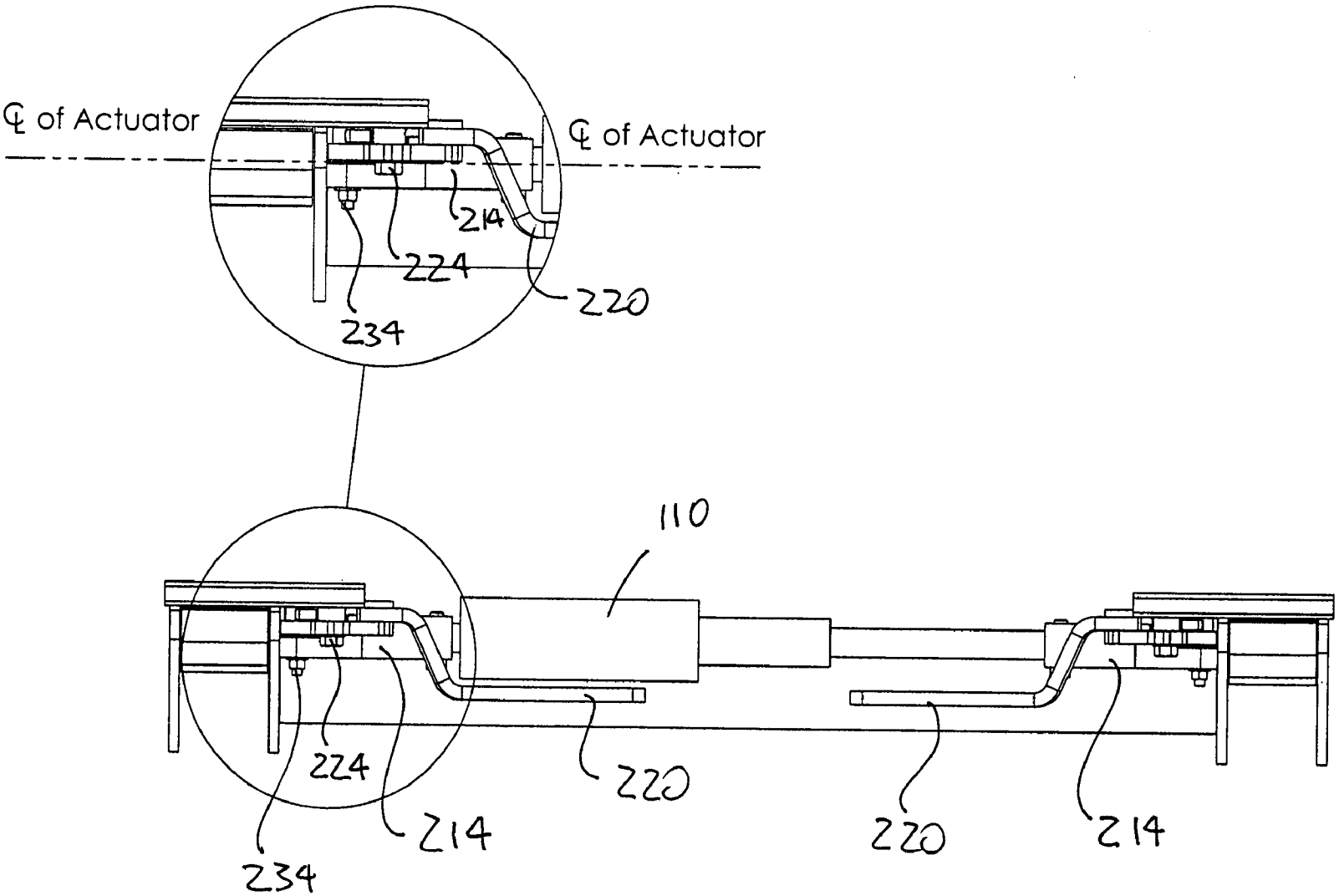
FIG. 12 is a top view of the electrically actuated quick attach system shown in FIG. 10.

FIGS. 10-12 illustrate another electrically actuated attachment system in accordance with an embodiment of the present invention. In this embodiment, handles 220 are pivotally mounted on the mounting plates 12 by means of handle mounting bolts 224. Each handle 220 includes a slot 226 which receives a locking pin connector 228 connected to the extendable locking pin 16 by a pivotable linkage surrounded by the spring 18. The end clevis 214 of each actuator arm is connected to the handle 220 by an actuator mounting bolt 234 which extends through an actuator mounting hole 232 in the handle 220. The actuator mounting hole 232 is most clearly seen in FIG. 14. Alternatively, the mounting hole 232 and bolt 234 may be replaced with a stud connected to the handle by welding or the like. Each handle 220 also includes a clutch stop tab 236 extending therefrom which stops rotation of the handle 220 at the desired position.

In FIG. 10, the end clevises 214 of the electric actuator 110 are extended, and the handles 220 are pivoted around the mounting bolts 224 to their downward positions with their hand grip levers extending substantially horizontally. In this position, the locking pin connectors 228 retained in the slots 226 force the extendable locking pins 16 to their downward locked positions. A portion of each handle 220 and a portion of each actuator end clevis 114 contacts a sidewall of the mounting plate 12 to stop rotation of the handle 220 in this position.

In FIG. 11, the end clevises 214 of the electric actuator 110 are retracted, which causes the handles 220 to rotate around the handle mounting bolts 224 until the clutch stop tabs 236 of the handles 220 contact sidewalls of the mounting plates 12 or the actuator 110 reaches its retracted end of stroke position. In this position, the slots 226 are rotated along with the locking pin connectors 228 to thereby retract the locking pins 16 to their upward unlocked positions. As more fully described below, a standard clutch contained in the electric actuator 110 may disengage when the clutch stop tabs 236 of the handles 220 contact the mounting plates 12. Also, the electric actuator 110 may reach its fully retracted end of stroke in this position.

FIG. 12 is a top view of the electrically actuated attachment system shown in FIG. 10, illustrating the alignment of the centerline of the electric actuator 110 with the interface between each end clevis 214 and each handle 220 in the region of the actuator mounting bolt 234 and actuator mounting hole 232. Each end clevis 214 is offset to permit the mounting of the electric actuator 110 centerline as close as possible to the load, thereby minimizing the side deflection of the electric actuator 110 as well. In accordance with this embodiment of the invention, this alignment improves the operation and reliability of the electric actuator 110.

Figure 13:
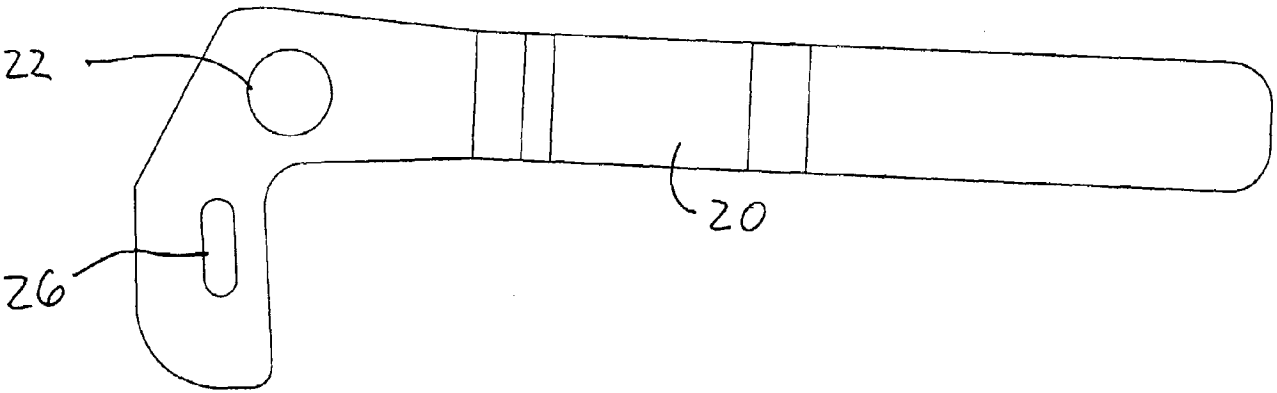
FIG. 13 is a front view of a manually operated quick attach handle.
Figure 14:
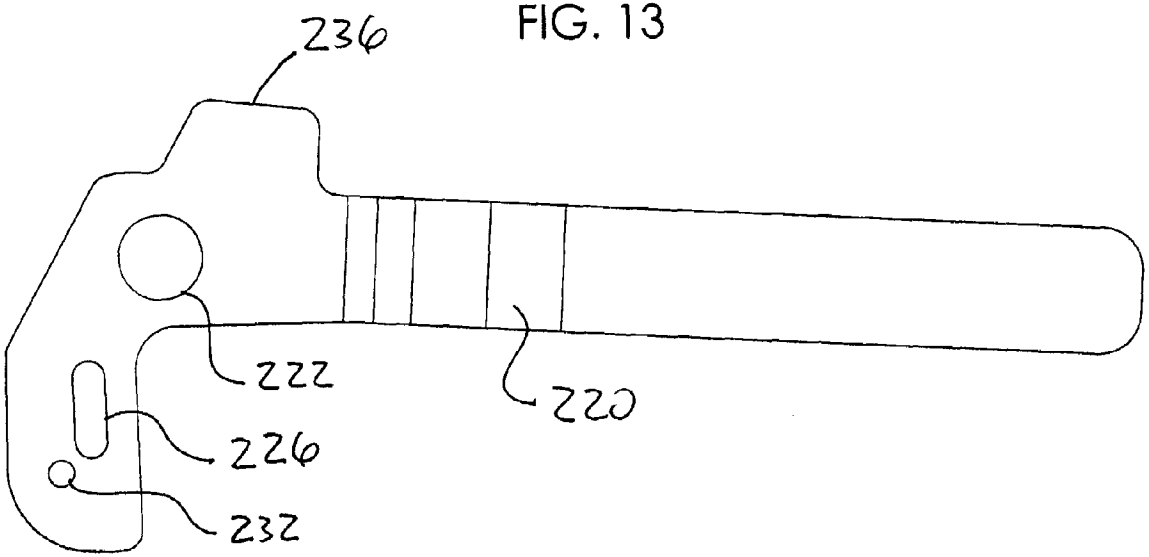
FIG. 14 is a front view of an electrically actuated quick attach handle including a hole for attachment of an electric actuator end clevis and an extended stop surface which may act to stop the retraction of the electric actuator during operation of the system in accordance with an embodiment of the present invention.

FIGS. 13 and 14 illustrate a manual handle 20 and an electrically actuated handle 220 in accordance with an embodiment of the present invention, respectively. As shown in FIG. 13, the manual handle 20 includes a mounting hole 22 and slot 26. The electrically actuated handle 220 shown in FIG. 14 includes a similar mounting hole 222 and slot 226, and further includes the actuator mounting hole 232 and the clutch stop tab 236. The handle mounting hole 222, locking pin linkage slot 226 and actuator mounting hole or stud 232 are arranged at different positions or regions in the plane of the handle 220.

Figure 16:
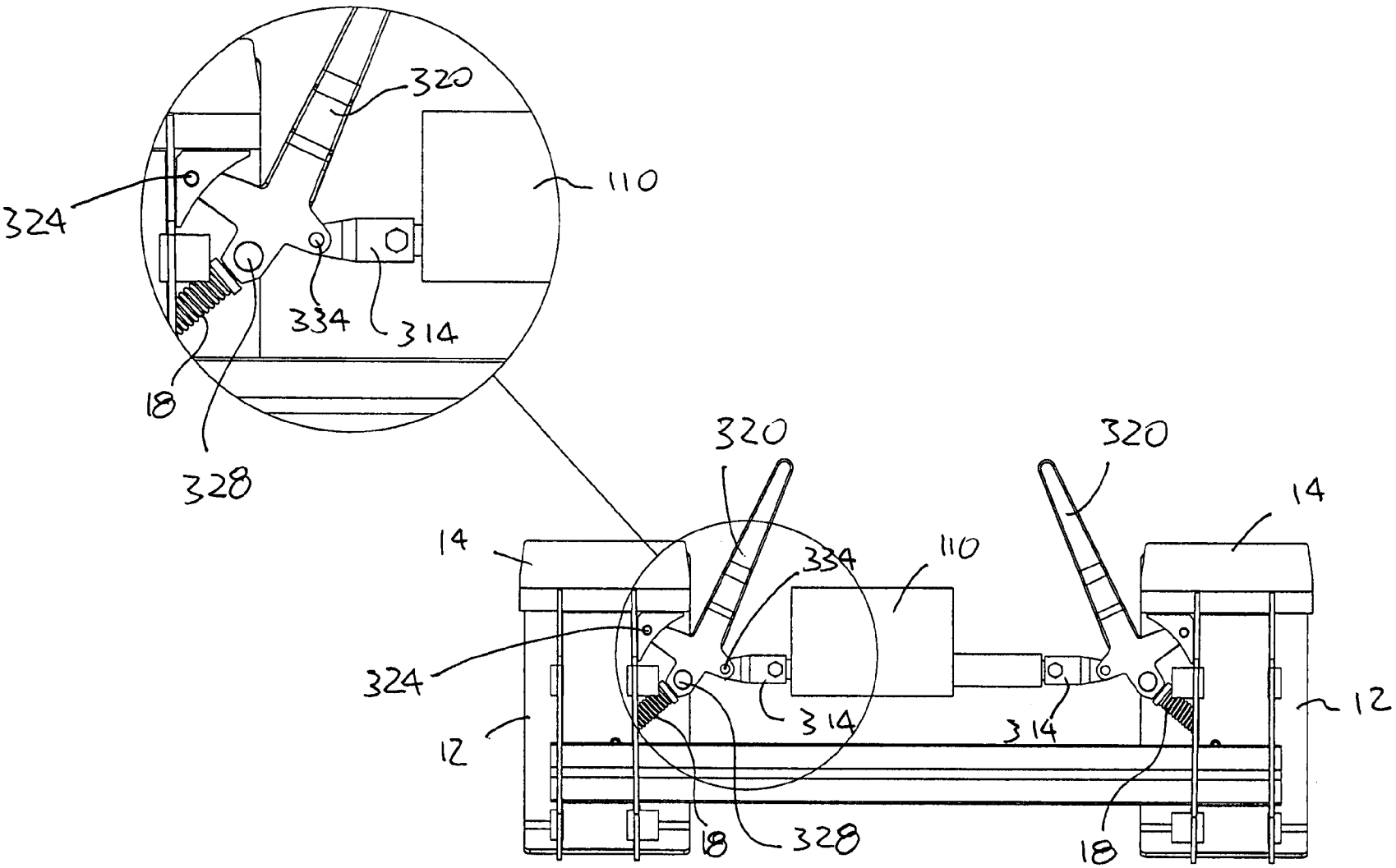
FIG. 16 is an elevational view of the electrically actuated quick attach system shown in FIG. 15, with the handles and locking pins in disengaged positions.
Figure 17:
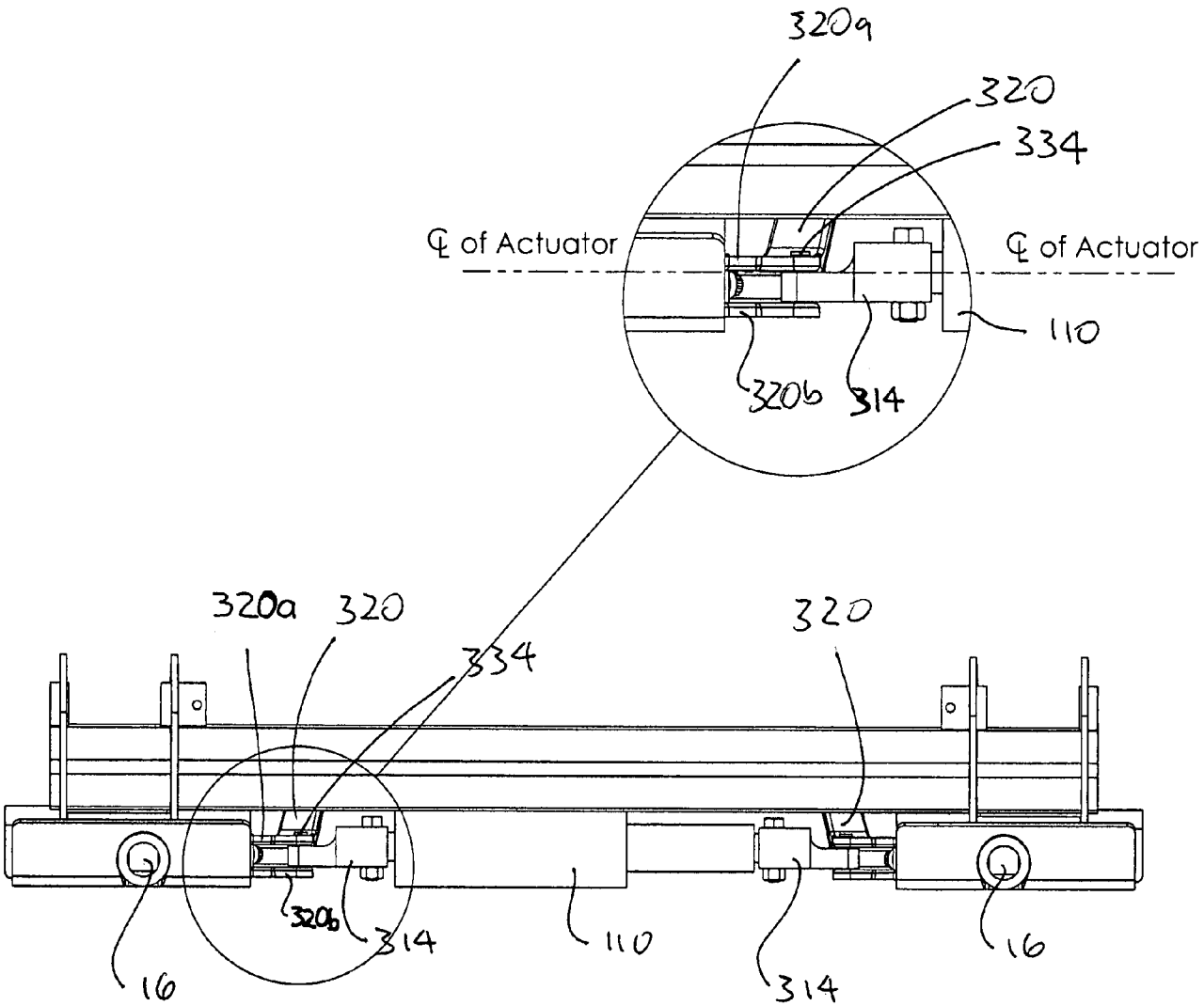
FIG. 17 is a bottom view of the electrically actuated quick attach system shown in FIG. 16.

FIG. 17 is a bottom view of the electrically actuated attachment system shown in FIG. 16, illustrating the connection of the ends 314 to the handles 320. As shown in the expanded section of FIG. 17, the 314 extends between two opposing faces 320*a* and 320*b* of the handle 320, and is secured by the actuator mountin pin 334. This connection is substantially aligned with the center line of the electric actuator 110, which provides improved operation and reliability for hte electric actuator 110.

The embodiment shown in FIG*s*. 15-17 has each end of the electric actuator 110 arranged such that it is straddled by the opposing faces 320*a* and 320*b* of the handles 320. This places the centerline of load as close to the centerline of the electric actuator 110 as possible. When the electric actuator 110 is operated in this configuration, side deflection is within recommended specifications and the operational life of the actuator is maximized.

Figure 18:
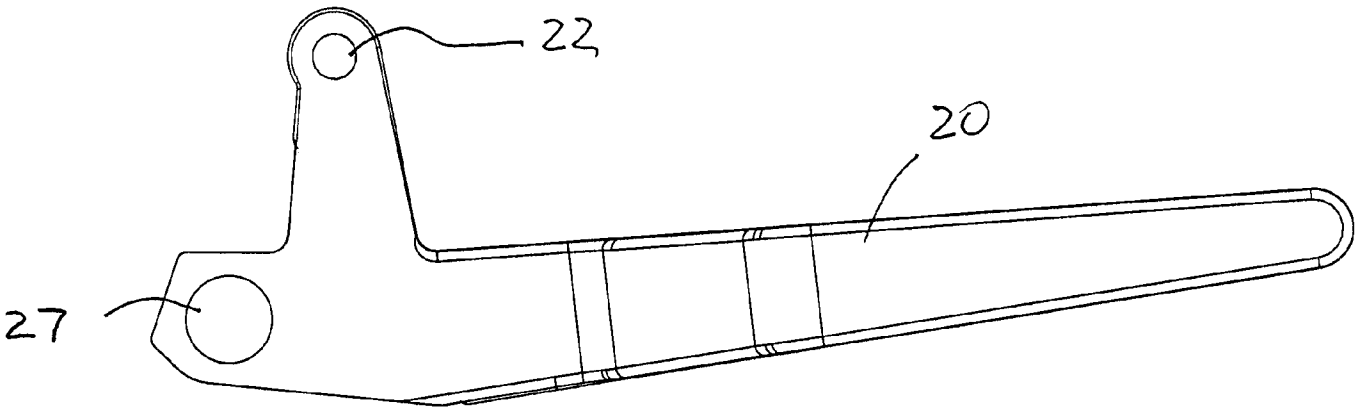
FIG. 18 is a front view of a manually operated quick attach handle.
Figure 19:
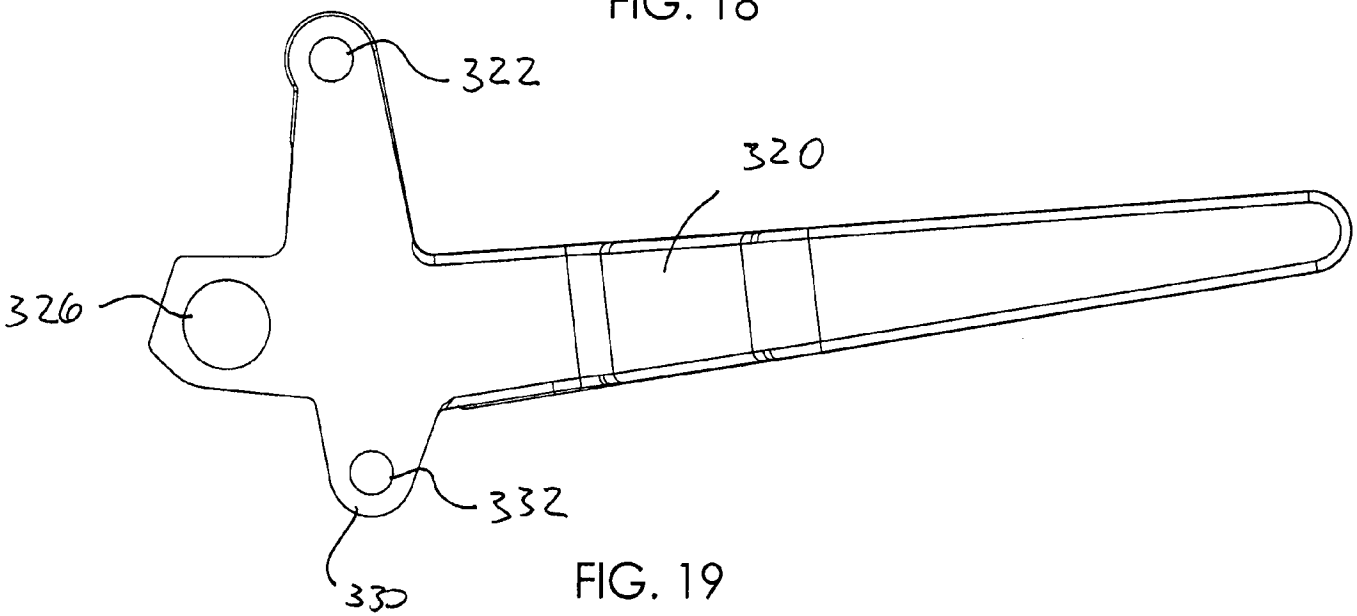
FIG. 19 is a front view of an electrically actuated quick attach handle including an extended portion having a hole for connection to an electric actuator clevis in accordance with an embodiment of the present invention.

FIGS. 18 and 19 illustrate a manual handle 20 and an electrically actuated handle 320 in accordance with an embodiment of the present invention, respectively. The manual handle 20 of FIG. 18 includes a mounting hole 22 and a hole 26 for the locking pin connector. The electrically actuated handle 320 of FIG. 19 includes a handle mounting hole 322 and locking pin connector hole 326, as well as the extended actuator mounting tab 330 having the actuator mounting hole 332 extending therethrough. The handle mounting hole 322, locking pin linkage hole 326 and actuator mounting hole 332 are arranged at different positions or regions in the plane of the handle 320.

In accordance with an embodiment of the present invention, the electric actuator 110 includes a standard internal automatically self adjusting, bi-directional clutch mechanism of any suitable known design to determine the locked and/or unlocked position for the quick attach system. For example, the clutch may make a ratcheting sound when it is activated, providing an audible indicator to the operator. The handles 120, 220 and 320 stop rotation in the locked and/or unlocked positions so as to activate the clutch mechanism of the electric actuator 110. The end clevises 114, 214 and 314 are preferably of a length such that the electric actuator 110 reaches its own internal end of stroke upon full retraction and thereby activates its internal clutch. This point may be reached when the handles are beyond center in the unlocked positions.

Electrical actuators may be prone to premature failure under certain conditions. One very undesirable condition is where the load placed on the actuator is offset from the centerline of the actuator. This will cause the actuator to deflect sideways (perpendicular to the axis of force) and ultimately cause the motor excessive stress as well as the internal components. In accordance with embodiments of the present invention, the electric actuator 110 is connected to the handles 120, 220 and 320 such that side deflection loads are reduced or eliminated.

By mounting the electric actuator 110 to the handles 120, 220 and 320 at locations other than the locking pin linkage pivot point, a clutch-type actuator may be used to determine locked and unlocked states of the quick attach system. The clutch-type actuator provides superior field performance and reliability as compared to limit switch actuators for this application.

The present electrically actuated system may fit both existing and newly manufactured quick attach systems within the front end loader industry. The present electrically actuated quick attach system has many advantages. It is easy to install with minimal wiring, and easy to field repair in the event the wiring gets pinched by the front end loader. The electric motor design permits fast operation, and require less power or drain on the vehicle's electrical system. The electric actuator is clean to maintain without the fluids that are required by hydraulics, and is easier and more economical to adapt to existing equipment in the field.

Whereas particular embodiments of this invention have been described above for purposes of illustration, it will be evident to those skilled in the art that numerous variations of the details of the present invention may be made without departing from the invention as defined in the appended claims.

The invention claimed is:

1. An attachment system for mounting attachments to a tractor comprising:

handles pivotally mounted on tractor attachment mounting plates, each handle including a connection to an attachment locking pin and a separate connection comprising a clevis between the handle and an actuator end; and an electric actuator connected to the actuator ends, wherein the actuator ends or portions of the handles contact portions of the mounting plates when the electric actuator is in an extended position.

2. The attachment system of claim 1, wherein each handle comprises a hand grip lever rotatable to a substantially horizontal position when the attachment system is in a locked position, and rotatable to an upward position when the attachment system is in an unlocked position.

3. The attachment system of claim 1, wherein each locking pin is extendable downward to a locked position and retractable upward to an unlocked position.

4. The attachment system of claim 1, wherein each locking pin connection comprises a slot extending through the handle slidably receiving a locking pin connector for the locking pin.

5. The attachment system of claim 1, wherein each locking pin connection comprises a hole extending through the handle and a locking pin connector for the locking pin extending through the hole.

6. The attachment system of claim 1, wherein each clevis connection comprises a hole extending through the handle and an actuator mounting bolt or pin extending through the hole connected to an actuator end clevis.

7. The attachment system of claim 1, wherein each clevis connection comprises a stud extending from the handle and connected to an actuator end clevis.

8. The attachment system of claim 1, wherein each handle is rotatable within a plane, and a center of rotation of the handle, the locking pin connection and the clevis connection are located at different positions in the plane.

9. The attachment system of claim 1, wherein the different positions are non-linearly aligned.

10. The attachment system of claim 1, wherein each handle comprises an extended actuator mounting tab located adjacent to the clevis connection.

11. The attachment system of claim 10, wherein the actuator mounting tab extends into a slot in an actuator end clevis.

12. The attachment system of claim 1, wherein each handle comprises opposing handle faces forming a clevis, and a portion of the actuator end extends between the opposing handle faces.

13. The attachment system of claim 1, wherein each clevis connection is substantially aligned in a vertical plane with a centerline of the electric actuator.

14. The attachment system of claim 1, wherein each handle rotates into contact with the portion of the mounting plate in order to stop rotation of the handle when the electric actuator is in the extended position.

15. The attachment system of claim 14, wherein the locking pins are extended to locking positions when the electric actuator is in the extended position.

16. The attachment system of claim 14, wherein each handle comprises a stop tab which contacts the portion of the mounting plate when the electric actuator is in the refracted position.

17. The attachment system of claim 1, wherein the actuator ends comprise clevises which contact the portions of the mounting plates when the electric actuator is in the extended position.

18. The attachment system of claim 1, wherein the electric actuator is in a retracted end of stroke position when the locking pins are in retracted unlocked positions.

19. The attachment system of claim 18, wherein the electric actuator comprises an internal clutch which disengages when the actuator reaches the retracted end of stroke position.

20. The attachment system of claim 1, wherein the electric actuator is in an extended position when the locking pins are in extended locked positions.

21. The attachment system of claim 20, wherein the electric actuator comprises an internal clutch which disengages when the actuator reaches the extended position.

22. The attachment system of claim 1, wherein each handle comprises:

a first region structured and arranged for pivotal mounting of the handle on the mounting plate;

a second region structured and arranged for connecting the locking pin to the handle; and a third region structured and arranged for connecting the actuator end to the handle.

23. The attachment system of claim 22, wherein the third region comprises an extended actuator mounting tab.

24. The attachment system of claim 22, wherein the handle comprises an extended stop tab structured and arranged to contact a portion of the mounting plate when the handle is rotated to an unlocked position.

25. The attachment system of claim 22, wherein the handle is substantially planar, and the first, second and third regions of the handle are located at different non-linearly aligned positions in the plane of the handle.

* * * * *

UNITED STATES PATENT AND TRADEMARK OFFICE

CERTIFICATE OF CORRECTION

PATENT NO. : 7,329,082 B2
APPLICATION NO. : 11/231187
DATED : February 12, 2008
INVENTOR(S) : Alan T. Warren It is certified that error appears in the above-identified patent and that said Letters Patent is hereby corrected as shown below:

Detailed Description
Column 5
Starting after Line 53, add the following paragraphs.

Figure 15:
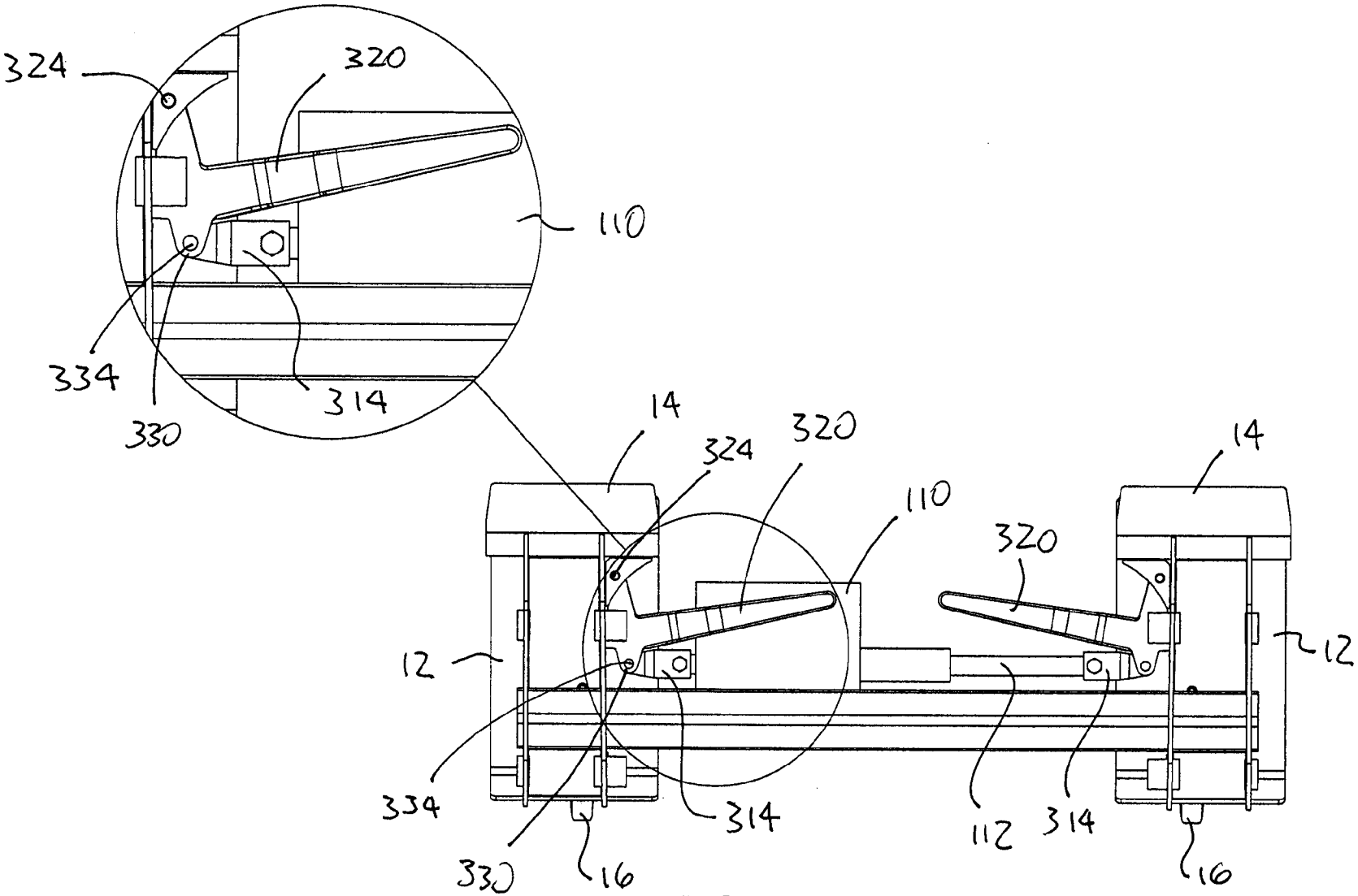
FIG. 15 is an elevational view of an electrically actuated quick attach system in accordance with a further embodiment of the present invention, with the handles and locking pins in engaged positions.

--FIGS. 15-17 illustrate an electrically actuated attachment system in accordance with a further embodiment of the present invention. In this embodiment, the ends 314 of the electric actuator 110 are connected to the handles 320 by means of actuator mounting pins 334. Each handle 320 includes an extended actuator mounting tab 330 through which the actuator mounting pin 334 extends. Each handle 320 is pivotally mounted on the mounting plate 12 by a handle mounting pin 324 which extends through a handle mounting hole 322 (shown most clearly in FIG. 19). As shown in FIGS. 16 and 19, each handle 320 includes a hole 326 which receives a locking pin connector 328. The locking pin connector 328 is connected by a pivotable linkage surrounded by the spring 18 to the extendable locking pin 16.

In FIG. 15, the ends 314 of the electric actuator 110 are extended to rotate the handles 320 around the mounting pins 324 to their downward positions with their hand grip levers extending substantially horizontally. In this position, the locking pin connectors 328 extend the locking pins 16 to their downward locked positions. The electric actuator 110 may reach its fully extended end of stroke in this position.

In FIG. 16, the ends 314 of the electric actuator 110 are retracted and the handles 320 are rotated around the mounting pins 324 to their upward positions. In this position, the locking pin connectors 328 are also rotated to positions which retract the locking pins 16 to their upward unlocked positions.--

Column 5, Line 57
After "...FIG. 17, the" insert --end--

Column 5, Line 59
After "...secured by the actuator" delete "mountin" and insert --mounting--

Column 5, Line 62
After "...reliability for" delete "hte" and insert --the--

Signed and Sealed this

Fourteenth Day of September, 2010

David J. Kappos

David J. Kappos
*Director of the United States Patent and Trademark Office*

Column 5, Line 63
After "...has each end" insert --314--

Claims
Claim 16, Column 8, Line 11
After "...is in the" delete "refracted" and insert --retracted--